US006453718B1

(12) United States Patent
Schmeink et al.

(10) Patent No.: US 6,453,718 B1
(45) **Date of Patent: *Sep. 24, 2002**

(54) MULTISTATION PRESS

(75) Inventors: Martin Schmeink, Suessen; Rudi Brandstetter, Adelberg; Kurt Metzger, Goeppingen; Stefan Veit, Donzdorf, all of (DE)

(73) Assignee: Schuler Pressen GmbH & Co., Goeppingen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/998,777

(22) Filed: Dec. 29, 1997

(30) Foreign Application Priority Data

Dec. 27, 1996 (DE) ..... 196 54 473

(51) Int. Cl.[7] ..... B21D 43/05

(52) U.S. Cl. ..... 72/405.1; 72/405.02; 100/207; 100/209

(58) Field of Search ..... 72/405.1, 404, 72/472, 452.5, 455, 405.01; 100/207, 209

(56) References Cited

U.S. PATENT DOCUMENTS 449,145 A * 3/1891 Wakely ..... 72/226
1,833,376 A * 11/1931 Simmons ..... 72/226
3,605,479 A * 9/1971 Bradlee ..... 72/452.5
4,137,840 A * 2/1979 Kubota ..... 72/455
5,595,111 A * 1/1997 Michael ..... 72/455
5,720,198 A * 2/1998 Nishida ..... 72/405.1
5,761,994 A * 6/1998 Itakura ..... 72/404

FOREIGN PATENT DOCUMENTS

| | | |
|---|---|---|
| DE | 1 452 772 | 10/1969 |
| DE | 28 04 806 | 8/1978 |
| DE | 44 08 449 A1 | 9/1995 |
| EP | 0 388 610 A1 | 2/1990 |
| EP | 0 439 684 B1 | 10/1990 |
| JP | 08-206883 | 8/1996 |

* cited by examiner

*Primary Examiner*—Daniel C. Crane
(74) *Attorney, Agent, or Firm*—Crowell & Moring LLP

(57) ABSTRACT

A multistation press, particularly a suction device press, for machining sheet metal parts is provided for the successive machining of workpieces in several stages. Several press stations are arranged behind one another so that workpieces pass through the stations successively. At least one transfer device transports the workpiece. A common driving device for all press stations has a drive shaft divided into shaft sections. At least one press station is assigned to each shaft section. Slides are driven by the drive shaft and are assigned to one press station, respectively. An adjustable coupling is provided between two successively arranged shaft sections for adjusting a specific phase shift between two successive press stations.

7 Claims, 7 Drawing Sheets

MULTISTATION PRESS

BACKGROUND AND SUMMARY OF THE INVENTION

This application claims the priority of German application 196 54 473.4, the disclosure of which is expressly incorporated by reference herein.

The present invention relates to a multistation press for the successive machining of workpieces in several stages, and more particularly, to a press having several press stations which are arranged behind one another and through which the workpiece passes successively, having at least one transfer device for transporting the workpiece, having a common driving device for all press stations which has a drive shaft divided into shaft sections, at least one press station being assigned to each shaft section to, and having slides which are driven by the drive shaft and which are assigned to one press station respectively.

EP 0 439 684 B1 discloses a stamping press which has a frame, a drive, a slide device driven by the drive, and a base plate device. A drive shaft is divided into shaft sections assigned to the slide sections. The slide sections are independent of one another. The base plate device is divided in the same manner into base plate sections which are supported independently of one another. As the result, the lower dead center positions of the individual slides are to be fixed in a phase-shifted manner in order to reduce the overall stress to the machine. As a result, to use long and narrow tools must be used.

It is a disadvantage that the known phase shifting referred to above is fixedly adjusted, whereby the press can be optimally designed only for one operating point. In this case, the phase shifting between the slide sections must naturally always be adjusted to the worst case with respect to the drawing depth, the workpiece width, etc.

DE-PS 1 452 772 describes a transfer press having a main slide and one or several additional slides. The additional slides with respect to the main slide pass through the lower dead center-point in a time-shifted manner to avoid press load peaks. It is also a disadvantage that the individual slides are in a fixed phase shift with respect to one another. As a result, the number of strokes of the press cannot be raised above a specific upper level.

It is therefore an object of the present invention to provide a multistation press in which the conditions with respect to the passage time and the stroke number are optimal for each specific workpiece, so as to achieve an increased yield. In particular, an adaptation of the phase shift of the individual press stations optimally to the stroke number of the press is now possible.

According to the present invention, this object has been achieved by the multistation press by providing that one or more adjusting devices change one or more phase shifts.

The adjustable coupling according to the present invention allows the individual press stations to be adjusted very precisely to their specific characteristics, such as the shape and the size of the workpiece and thus of the tool, the forming degree, the drawing depth and additional influencing variables occurring during the forming of sheet metal, whereby the entire pressing operation can be variably configured. The phase shift can advantageously be adjusted in a targeted manner to each individual drawing depth or other specific conditions of a press station.

On one hand, it is now possible to provide more time for the transport of the workpieces, and particularly determine the precise time duration for the transport because the slide of the individual press station can be adjusted to reach the lower dead center at an arbitrarily adjustable later point in time.

On the other hand, the slides can now also be moved at a higher rate because the loss of time resulting from this higher speed for the transport system can be compensated. That is, the slide of the following press station passes at a later point in time through the lower dead center and the transport system therefore has the same time available as previously.

Furthermore, the present invention makes possible the compensation of a longer transport path to be covered, which may occur for various reasons, by way of a variable adjusting of the coupling, and thus of the movement, of the respective slide.

Because multistation presses usually have a very long service life, new workpieces, new tools or new technologies may result in changes with respect to the use of the press. These changes can normally not be taken into account during the construction of the machine. The adjustable coupling of the present invention now makes it possible to better adapt multistation presses to different tools or workpieces, and also to make changes later or to take customers' wishes into account.

As the result of the multistation press constructed in accordance with the present invention, the stroke number can be adapted to the press conditions and in many cases can be increased. This also results in the rise of the ejected parts by the machine, because this yield depends directly on the number of press strokes. The adjustment of the couplings can be carried out as a function of different parameters within the multistation press, such as the workpiece transport path, the tool size or the workpiece drawing depth.

An optimal adaptation of the multistation press and of the pressing operation taking place in the multistation press to the above-described parameters which are decisive for the pressing operation now result. Different devices may be provided for adjusting the couplings. Particularly simple adjusting possibilities are achieved with a locking device of the drive shaft, a locking device of one of the slides or of a pressure point adjusting device. It is only necessary to be able to lock the drive at any point in order to be able to adjust the individual couplings to the respective conditions.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
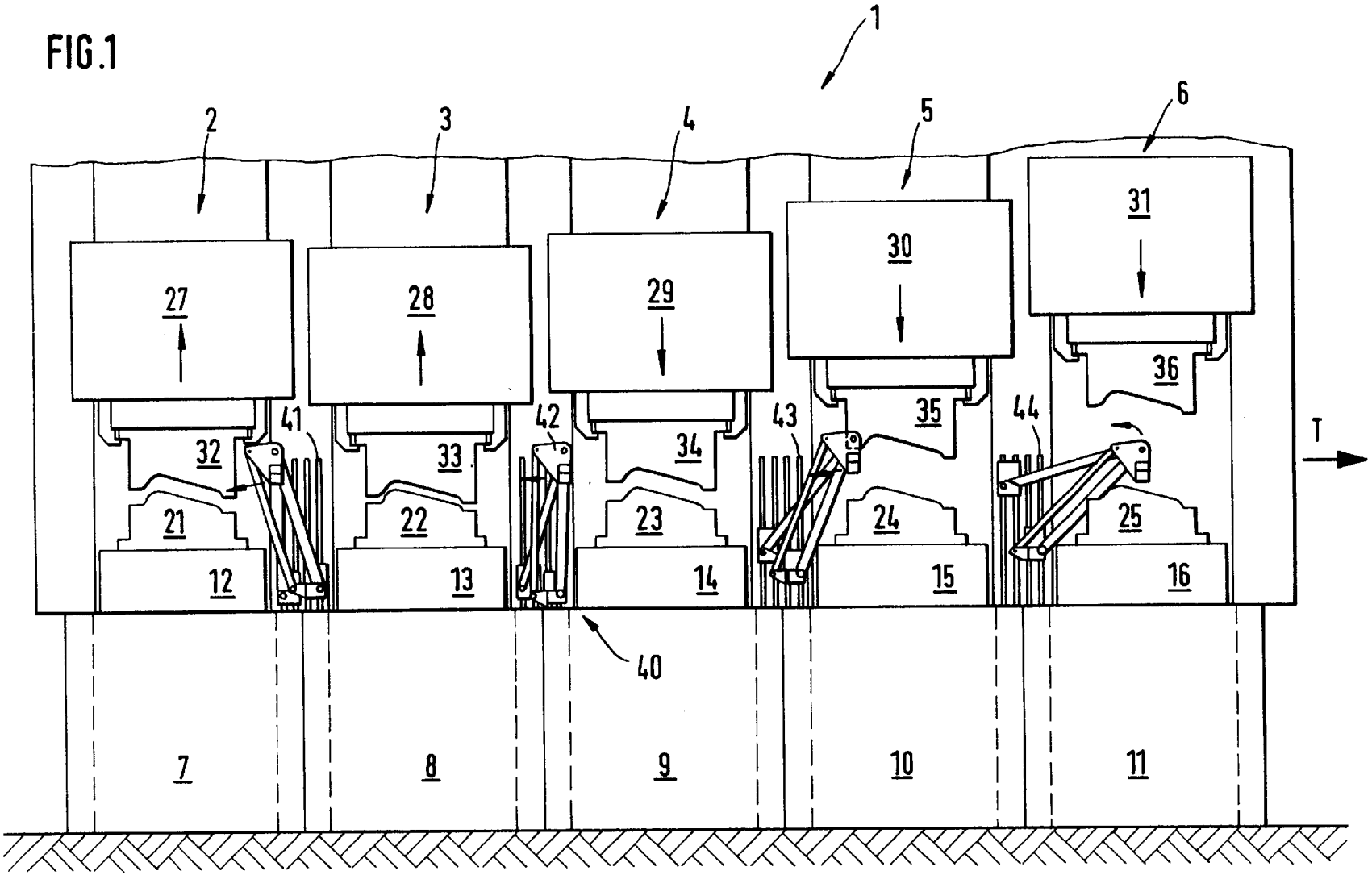
FIG. 1 is a schematic elevational view of a multistation press according to the present invention with a transfer system arranged therein.

FIG. 1 shows the lower portion of a multistation press 1 which is divided into work stations or press stations 2, 3, 4, 5, 6. Each press station 2, 3, 4, 5, 6 has a bedplate 7, 8, 9, 10, 11 on whose top side one sliding table 12, 13, 14, 15, 16 respectively is arranged. Bottom tools 21, 22, 23, 24, 25, which are part of the respective tool, are situated on the sliding tables 12 to 16. Slides 27, 28, 29, 30, 31 are assigned to the press stations 2 to 6. On the slides 27 to 31, top tools 32, 33, 34, 35, 36 are mounted which are provided for cooperating with the bottom tools 21 to 25. As also illustrated in FIG. 1, the slides 27 to 31 are situated at different heights inside their press stations 2 to 6.

With respect to a passage direction T, the press stations 2 to 6 are arranged behind one another and are linked to one another by a transfer system designated generally by the numeral 40 which is formed by separate transfer devices 41, 42, 43, 44. Because of the separate transfer devices 41 to 44, the transfer system 40 is also called a segmented transfer system 40.

The transfer devices 41 to 44 may be of an identical construction, in which case the transfer system 40 is constructed as a so-called two-axis transfer system 40. That is, the transfer system 40 carries out only one transport step and one lifting stroke and, in contrast to other known transfer systems which were usually constructed as three-axes systems, a closing operation is eliminated. The transfer devices 41 to 44 can be controlled independently of one another.

Figure 2:
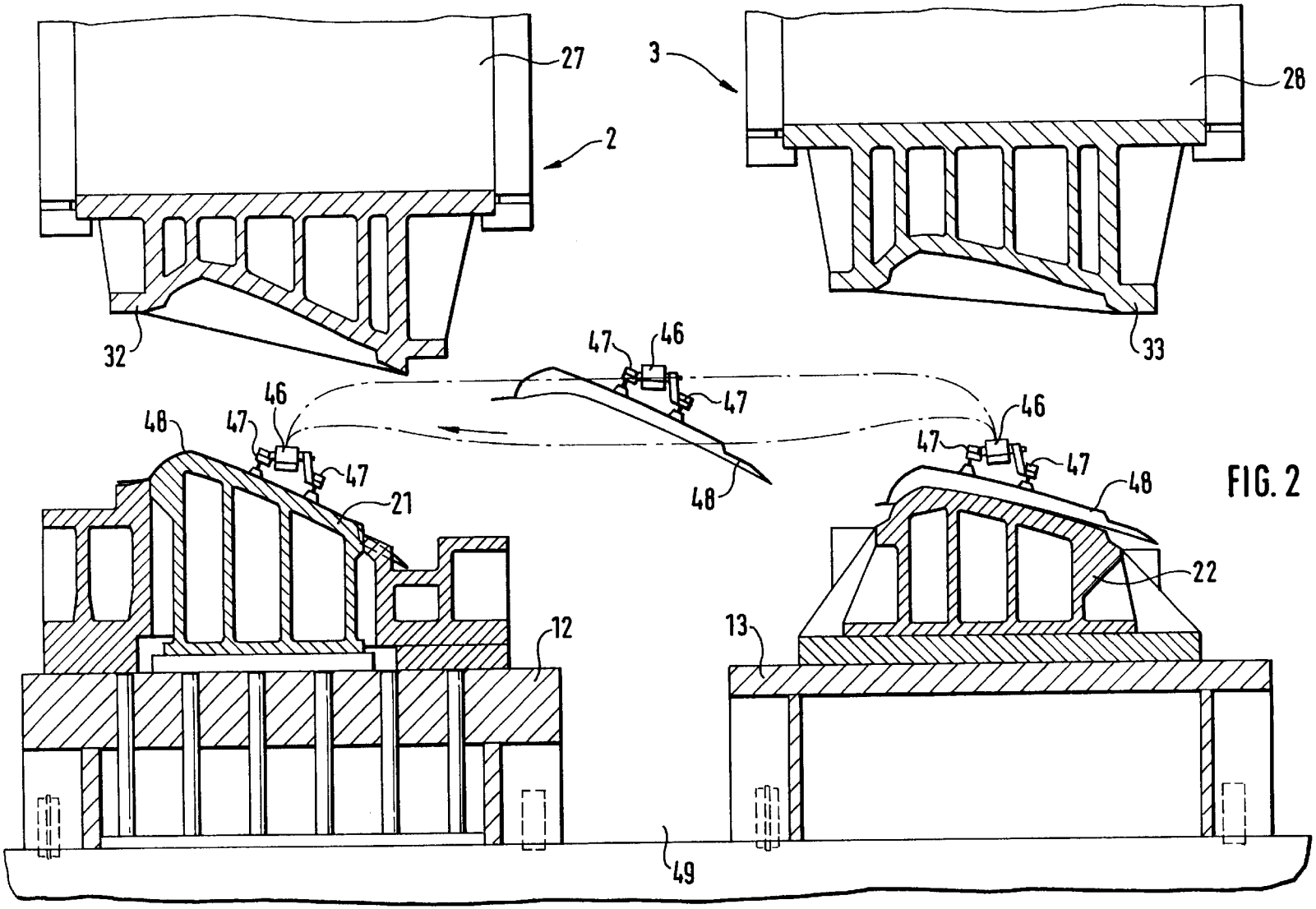
FIG. 2 is an enlarged isolated view of a portion of the press shown in FIG. 1 but with a workpiece.

The method of operation of the transfer devices 41 to 44 will now be explained as an example by way of the transfer device 41 shown in FIG. 2. A cross traverse 46 mounted on the transfer device 41 is illustrated in three different positions. Two gripping devices are arranged on the cross traverse 46 which are constructed as suction spiders 47, whereby a workpiece 48, which is also shown in three different positions, can be transported. The three positions in which the workpiece 48 is situated are on the bottom tool 21, on the bottom tool 22 as well as between the press stations 2, 3.

Figure 3:
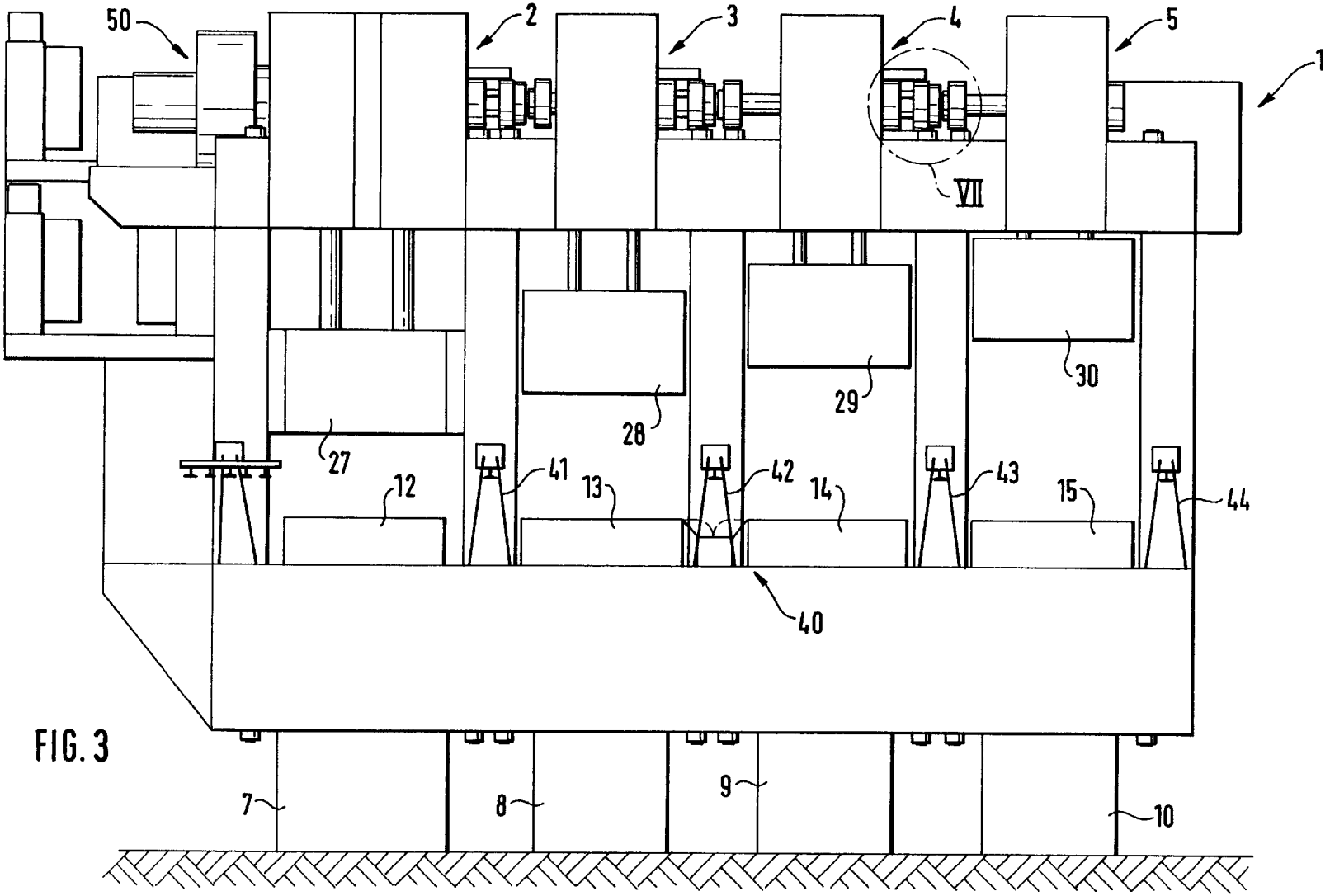
FIG. 3 is a view of a multistation press according to the present invention similar to FIG. 1 but showing another embodiment of the driving device.

The slides 27, 28 are moved up and down by a driving device 50. The driving device 50 is illustrated in the embodiment of FIG. 3, and the construction of the driving device 50 will therefore discussed below. The movement of the slides 27, 28 forms the workpiece 48 corresponding to the design of the bottom tools 21, 22 as well as of the top tools 32, 33. The transfer device 41 is now provided for transporting the workpiece 48 from one press station 2 into the next press station 3. This transport operation must be carried out as quickly as possible in order to be able to reach a maximal rate of the slides 27, 28 and thus a maximal stroke number of the multistation press 1.

After passing through press station 3, the workpiece 48 is now transported by the transport device 42 into the press station 4 in the same manner, until it finally leaves press station 6 has a finished part. Naturally, as soon as the workpiece 48 leaves one of the press stations 2 to 6, a new workpiece is inserted in a generally known manner into the respective press station 2 to 6 and during a down stroke each slide 27 to 31 processes a workpiece.

Because the upward and downward movement of the slides 27, 28 is triggered in a known manner by a rotational movement of the driving device 50, the linear movement of the slides 27, 28 will be explained in the following by a circular movement at an angle of 360°. Thus an upper dead center OT of the slides 27, 28 represents the 0° and the 360° point of the movement. A lower dead center UT therefore represents the 180° point of the movement. Thus, the downward movement of the slides 27, 28 takes place in a range of between 0° and 180°, whereas the upward movement of the slides 27, 28 is between 180° and 360°.

The degrees mentioned in the following should only be considered as examples and are determined by various parameters, such as the workpiece 48, the bottom tools 21, 22, the top tools 32, 33 as well as by various other factors. For example, the transfer device 41 may not move into the press station 2 before a 240° position of the slide 27 is reached. There, the transfer device 41 grips the workpiece 48 by way of the suction spiders 47 and moves in the direction of press station 3.

In order to bring the workpiece 48 for subsequent treatment into the press station 3, the transfer device 41 may have left the press station 3, for example, at a 120° position. This therefore results in an angle of rotation of 240° in which the transfer device 41 must have completed the loading of press station 3 in order to avoid collisions. This angle of rotation can also be converted to a defined time because time is part of each path and angle of rotation. During this time, the transport operation must then be concluded which is also called a time window for the transport operation.

Because the press stations 2 to 6 all have the same stroke number, the above-described loading and unloading operation applies to all press stations 2 to 6. In order to allow a longer time for the movement of the transfer device 41 to carry out this operation, slide 28 is now offset by, for example, 20° in comparison to slide 27. In the case of the 180° position of slide 27, slide 28 will then only be in the 160° position. This means that the transfer device 41 now has 260° available for the loading and unloading operation instead of previously 240°. In other words, a larger time window is obtained in which the transport operation can be completed. As a result, a higher slide rate can be achieved which raises the stroke number. A longer path to be covered between press station 2 and press station 3 also can now be bridged without any reduction of the slide rate.

The above-described phase shifting is also carried out in the same manner in each case between slides 28 to 31. Although, as a result, the workpiece 48 remains in the multistation press 1 for a longer time period (which according to the adjustment of the phase shifting of the slides 27 to 31 may be up to 180° and more), this does not affect the number of strokes of the multistation press 1. Because the number of strokes does not fall but may even rise because of the optimizing of the slide rates, increased yields can even be expected. As is well known, the stroke number of the multistation press 1 determines the yield of workpieces 48, not the passage time of an individual workpiece 48.

The optimal phase shift between two successively arranged slides 27 to 31 depends on different influencing factors which are generally part of the area of the press layout. These are, for example, the stroke number of the multistation press 1, the forming degree of the workpiece 48 to be formed, which also includes the drawing depth; the width of the workpiece 48, as well as generally the transport movement of the workpiece 48. The transport movement of the workpiece 48 depends mainly on the geometric condition of the press stations 2 to 6.

Figure 4:
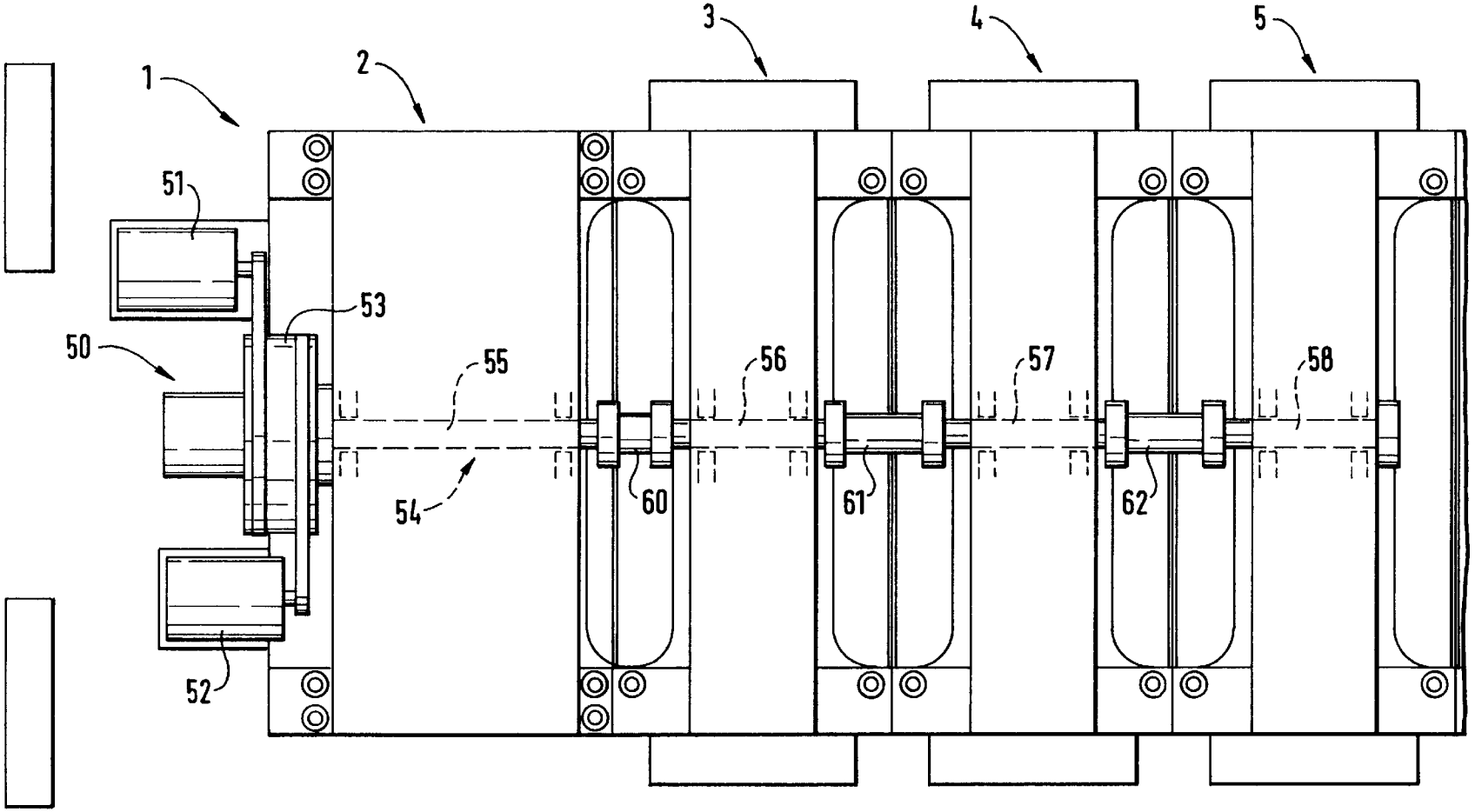
FIG. 4 is a plan view of the multistation press of FIG. 3.
Figure 5:
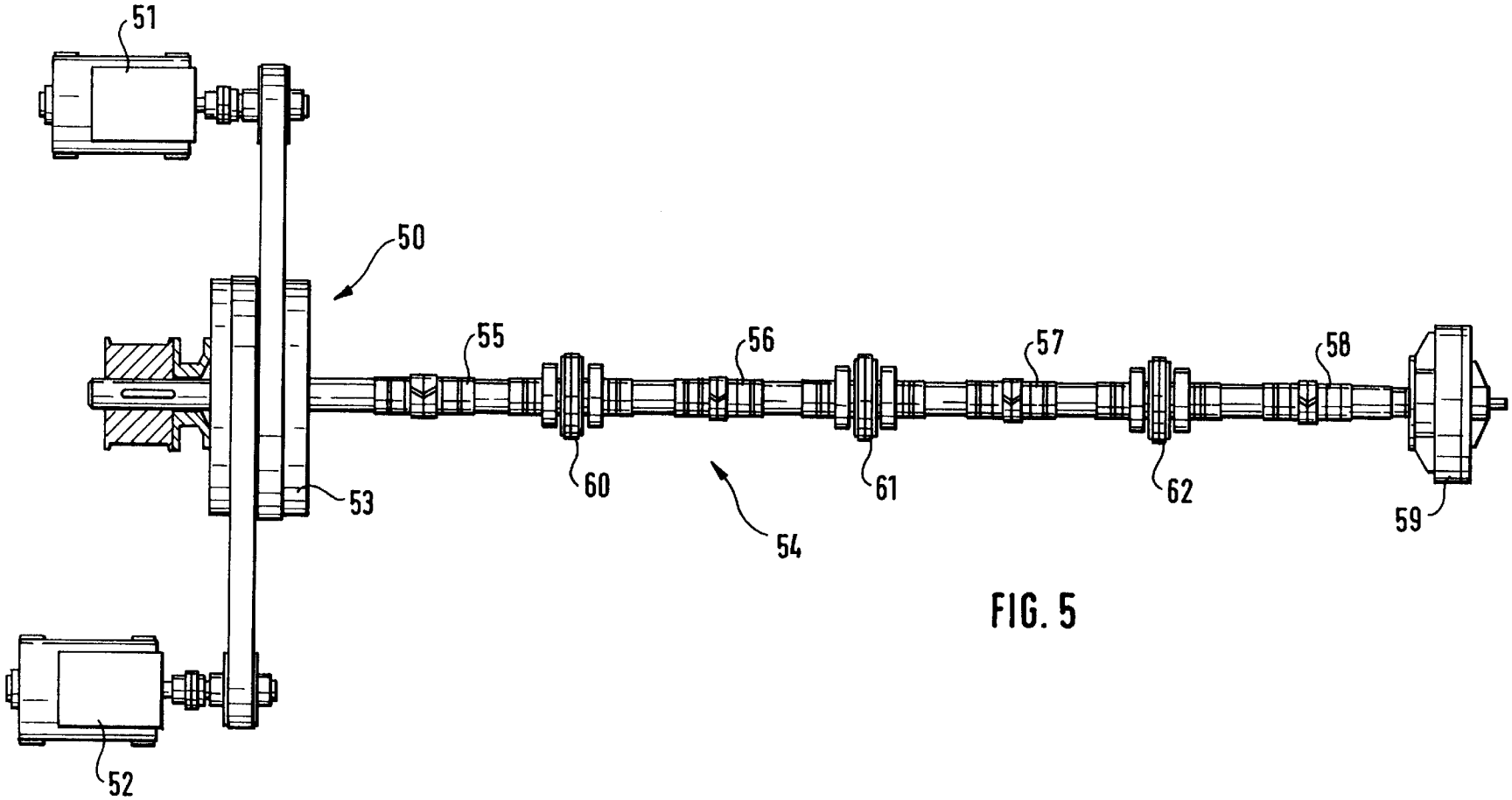
FIG. 5 is a view of a detail of the driving device of FIG. 4.
Figure 6:
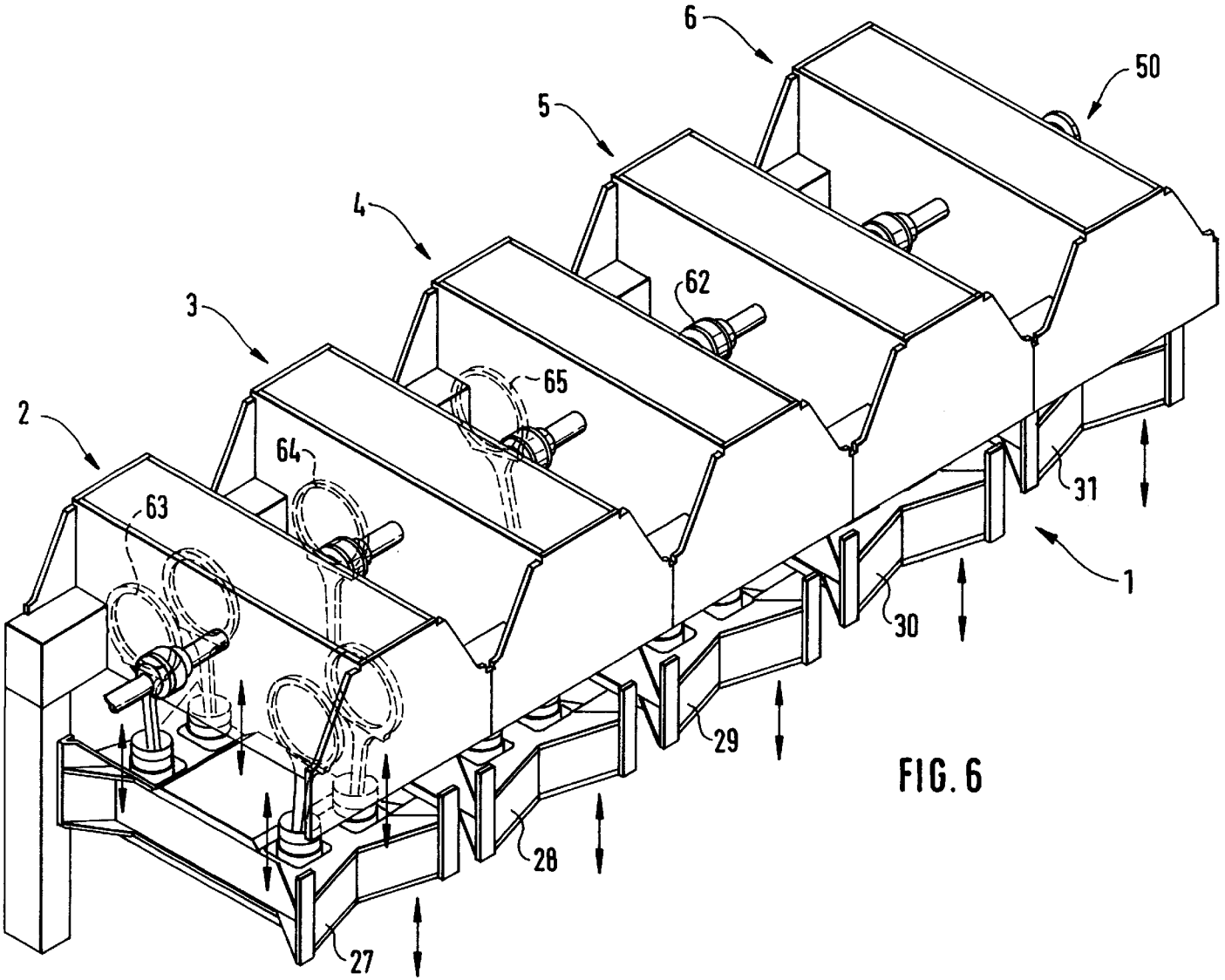
FIG. 6 is a perspective view of the upper part of the multistation press of FIG. 1.

FIGS. 3 and 4 are different views of another embodiment of the multistation press 1. For reasons of clarity, only four press stations 2 to 5 are shown. This press has essentially the same characteristics as the multistation press 1 shown in FIG. 1, but the driving device 50 will be discussed here. FIG.

5 is essentially a complete representation of the driving device 50 of the

A transmission device 53 connects the driving motors 51, 52 with a drive shaft 54. The drive shaft 54 is divided into several shaft sections 55, 56, 57, 58 which are each assigned to a press station 2 to 5. A central locking system 59 of known construction is situated at the end of the drive shaft 54 which is away from the driving motors 51, 52. The shaft sections 55 to 58 are connected with one another by couplings 60, 61, 62.

The couplings 60 to 62 are adjustable. As a result, the above-described phase shift between the slides 27 to 31 can be arbitrarily adjusted. For this, it is necessary that each coupling 60 to 62 can be individually adjusted or engaged and disengaged. Adjustment of the couplings 60 to 62 can be carried out in different known manners.

If, for example, the shaft section 58, is locked, the phase shift between the shaft sections 57 and 58 can be adjusted by adjusting the coupling 62. An additional locking of the shaft section 57 allows the phase shift between the shaft section 56 and the shaft section 57 to be therefore adjusted by adjusting the coupling 61. Of course, this adjustment of the couplings 60 to 62 for adjusting a phase shift between shaft sections 55 to 58 and thus between press stations 2 to 5 can take place in arbitrary combinations by locking one of the shaft sections 55 to 58 respectively.

Another approach for adjusting the couplings 60 to 62 and thus for adjusting the phase shift is the locking of the slide 31. This adjustment of the couplings 60 to 62 is basically carried out in the same manner as the locking of the shaft sections 55 to 58. As a result, the drive shaft 54 cannot rotate in the area away from the driving motors 51 and 52. Such a locking device for locking one of the slides 27 to 31 is of generally known construction and normally already exists on the slides 27 to 31 of multistation presses 1.

A so-called three-point adjusting device offers an alternative for adjusting the couplings 60 to 62. It is also normally provided in the upper part of the slides 27 to 31. According to its original purpose, the three-point adjusting device is provided for adapting the slide to different tools. Therefore, by the simultaneous locking of all slides 27 to 31 with the three-point adjusting device, the desired phase shift of the slides 27 to 31 can be adjusted in a simple manner. The slides 27 to 31 are fixed by a respective sealing. The couplings 60 to 62 are now released. The process of the three-point adjustment rotates the coupling halves with respect to one another. When the new value of the phase shift has been reached, the couplings are locked again.

Figure 7:
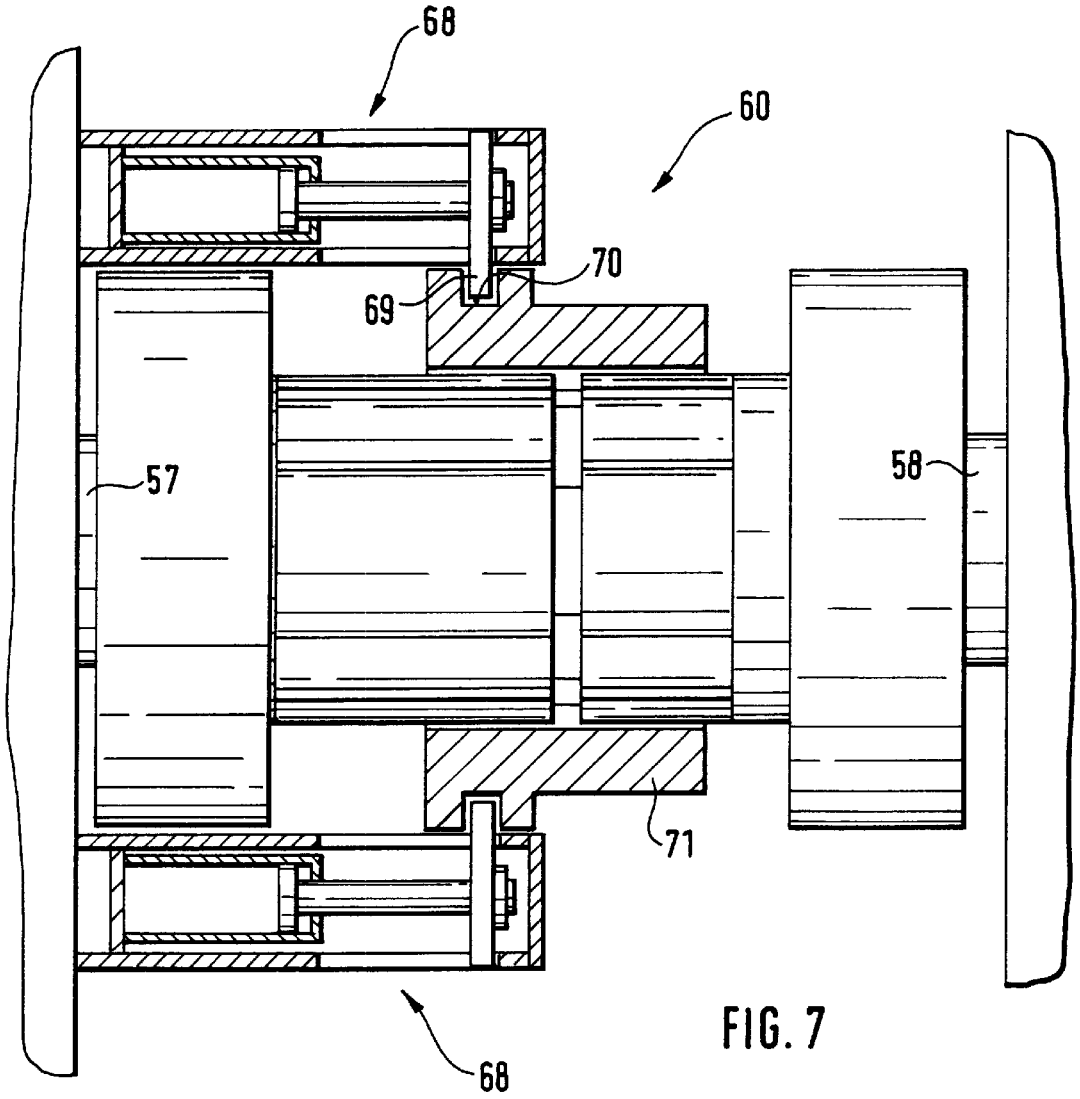
FIG. 7 is an enlarged view of the adjustable coupling shown in the isolated dot-dash circle Line VII of FIG. 3.

FIG. 7 shows an embodiment of the coupling 60, representing the couplings 60 to 62. Here, the coupling 60 connects the shaft section 57 with the shaft section 58. Several hydraulic cylinders 68 are mounted on the circumference of the coupling 60. A projection 69 mounted on the hydraulic cylinder 68 engages in a recess 70 of a sleeve 71 which is also part of the coupling 60.

In operation, the sleeve 71 connects shaft sections 57, 58. For adjusting a new phase shift, the sleeve 71 is shifted to the left by the hydraulic cylinders 68, and the connection between the sleeve 71 and shaft section 58 is released. Now shaft section 58 can be rotated with respect to shaft section 57. When the new position has been reached, the sleeve 71 is moved to the right again by the hydraulic cylinders 68, and the shaft sections 57, 58 are again connected.

Thus, the couplings 60 to 62 can be adjusted, whereby a phase shift of any magnitude can be adjusted between press stations 2 to 6. Naturally, it is within the scope of the invention to connect an arbitrary number or press stations with one another by way of the above-described couplings and to adjust a corresponding phase shift between these press stations.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Multistation press for the successive machining of workpieces in a plurality of stages and having a suction device press for machining sheet metal parts, comprising a plurality of press stations arranged one behind another and through which each of the workpieces passes successively, at least one transfer device for each press station for transporting the workpieces, each transfer device controlled independently of one another, a driving device common to all press stations having a drive shaft divided into shaft sections, at least one of the press stations being assigned to each shaft section, slides operatively driven by the drive shaft and respectively assigned to one of the press stations, and at least one adjusting device for effecting at least one phase shift between two shaft sections of press stages arranged one behind another for adjusting, individual press stations so that a slide of a downstream one of the press stages passes at a later time through a lower dead center position as a function of a predetermined operating characteristic to optimize transport time of the workpieces between the press stages by the at least one transfer device, in relation to a stroke rate of the slides of the press, by selection of a specific phase shift between two successive slides of the press such that the stroke rate can be adapted to variable press conditions.

2. Multistation press according to claim 1, wherein the at least one phase shift is adjustable as a function of a transport path of the workpieces within the multistation press.

3. Multistation press according to claim 1, wherein the at least one phase shift is adjustable as a function of tool size within the multistation press.

4. Multistation press according to claim 1, wherein the at least one phase shift is adjustable as a function of a workpiece drawing depth within the multistation press.

5. Multistation press according to claim 4, wherein the drive shaft includes a locking device for adjustment of the at least one phase shift.

6. Multistation press according to claim 1, wherein at least one of the slides has a locking for adjusting the at least one phase shift.

7. Multistation press according to claim 1, wherein the at least one adjusting device is a three-point adjusting device.

* * * * *